United States Patent [19]

Santen

[11] 4,310,350

[45] Jan. 12, 1982

[54] RECOVERING NON-VOLATILE METALS FROM DUST CONTAINING METAL OXIDES

[75] Inventor: Sven Santen, Hofors, Sweden

[73] Assignee: SKF Steel Engineering Aktiebolag, Hofors, Sweden

[21] Appl. No.: 200,153

[22] Filed: Oct. 24, 1980

[30] Foreign Application Priority Data

Jun. 10, 1980 [SE] Sweden ..... 8004313

[51] Int. Cl.[3] ..... C21C 5/52

[52] U.S. Cl. ..... 75/10 R; 75/11

[58] Field of Search ..... 75/10 R, 11, 12, 65 EB, 75/65 R

[56] References Cited

U.S. PATENT DOCUMENTS 3,429,691 2/1969 McLaughlin ..... 75/10 R 3,834,895 9/1974 Cachat ..... 75/10 R 3,862,834 1/1975 Waclawiczek ..... 75/10 R

*Primary Examiner*—P. D. Rosenberg

*Attorney, Agent, or Firm*—Brumbaugh, Graves, Donohue & Raymond

[57] ABSTRACT

A method of recovering non-volatile metals from materials in dust form containing metal oxides, comprising the steps of blowing the material into the lower portion of a reactor, said reactor containing a solid reducing agent, passing said starting material into a reduction zone within said lower portion, said reduction zone being maintained by the use of a plasma generator adjacent thereto, substantially instantaneously reducing and melting said starting material in sad reduction zone, and removing the melted and reduced metal product from the bottom of the reactor.

6 Claims, 1 Drawing Figure

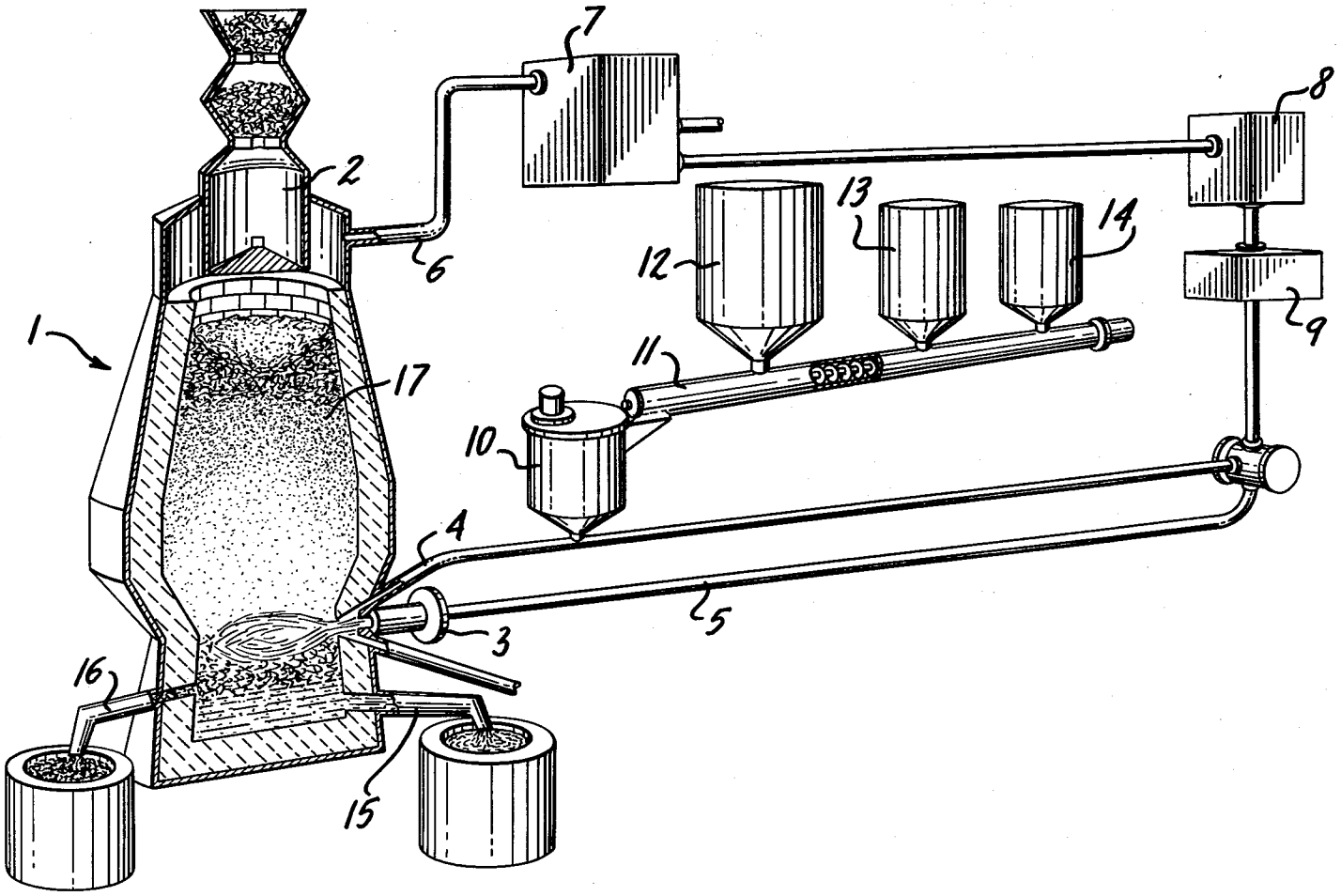
8
9
14
13
12
11
10
7
6
2
17
4
3
5
15
16
1

RECOVERING NON-VOLATILE METALS FROM DUST CONTAINING METAL OXIDES

BACKGROUND OF THE INVENTION

The present invention relates to a method of recovering non-volatile metals from material in dust form containing metal oxides. More particularly, the invention may be employed in the manufacturing of chromium from chromiferous metal oxides in dust form.

When refining metal melts according to conventional methods considerable quantities of metal oxide dust are obtained. This dust is normally recovered from the exhaust gases by means of flue gas filters of the like. In the Nordic countries alone about 50,000–60,000 tons per year of such metal oxide dust is obtained.

Even after being recovered, the dust has for a long time constituted a major problem from the environmental point of view, since it contains considerable quantities of heavy metals and also toxic chromium compounds. Heretofore, the dust has been stored as waste and dumped since no technically or economically feasible processing methods have been discovered. In this regard, U.S. Pat. No. 4,072,504 discloses a method of reducing metal oxides including the step of pre-reducing the oxides with the reducing gases released during final reduction. The present invention represents an improvement over the method disclosed in said U.S. Pat. No. 4,072,504 in that the pre-reduction step disclosed therein is neither necessary nor desirable and also because the present invention is particularly suited for the treatment of waste dust (which treatment is not mentioned in the U.S. Pat. No. 4,072,504.

BRIEF SUMMARY OF THE INVENTION

It has now been found according to the invention that such dust can be processed for the first time under economically acceptable conditions. The invention thus not only solves the environmental problem posed by the storage of toxic wastes, but at the same time makes use of metals, particularly chromium, nickel and molybdenum, present in the waste dust.

In the method according to the invention, the dust containing metal oxides, is blown into the bottom of a reactor filled with solid reducing agent and brought to pass a reduction zone generated by means of a plasma generator, so that the oxides of non-volatile metals contained in the dust are brought to substantially instantaneous final reduction and melting. By balancing the energy supplied and the material containing metal oxide, the temperature of the metal obtained is regulated to between 1500° and 1650° C.

According to a preferred embodiment of the invention described below, the dust containing metal oxide is blown into the reactor by means of a carrier gas, and the reaction gas generated in the reaction may suitably at least partially be recycled as the carrier gas. Furthermore, slag-formers and possibly a fuel such as carbon and/or hydrocarbon may also be added to this carrier gas. Some of the reaction gas generated in the reactor may also be used as a transport medium for thermal energy and thus as plasma gas if a plasma generator is used. In the preferred embodiment of the invention the energy supply is provided by electric energy, for instance by means of conventional electrodes or plasma burners.

Any excess reaction gas generated in the reaction, which contains primarily carbon monoxide and hydrogen gas, may then be used for other purposes, e.g. such as to generate electricity.

BRIEF DESCRIPTION OF THE DRAWING

For a better understanding of the invention, reference may be made to the following description of an exemplary embodiment taken in conjunction with the single figure of the accompanying drawing which illustrates diagrammatically a mode of carrying out the invention.

DESCRIPTION OF THE PREFERRED EMBODIMENT

In the drawing a shaft-like reactor 1 is provided in its upper part with a gastight supply sluice 2 for solid reducing agent, such as coke. The reactor temperature is regulated by means of one or more plasma burners 3.

The dust to be processed is blown into the lower part of the reactor 1 immediately before the plasma burner, with the help of a feed gas, through pipe 4. The plasma burner is also connected to a supply pipe 5 for a transport medium (plasma gas) for the thermal energy.

A portion of reduction gas generated in the reactor 1 is recovered and used as feed gas and plasma gas, respectively. Said reduction gas leaves the reactor 1 through an outlet 6 and the temperature can then suitably be regulated by passage through a heat-exchanger 7. In the example shown, about 20% of the reduction gas passing the heat-exchanger 7 is returned as feed gas and plasma gas via gas-cleaning equipment 8, a subsequent fan and possibly a compressor 9. The remaining 80% of the reduction gas leaving the heat exchanger, which contains carbon monoxide and hydrogen, may be used for other purposes, for example the generation of electricity.

The feed gas pipe 4 is arranged to cooperate with a feed means 10, such as a pneumatically operated feeder, which is connected to a feed channel 11 which in turn cooperates with three storage vessels 12, 13, 14 containing the dust to be processed, carbon powder and slag-former, respectively.

In operation, as the dust is injected into the reactor, it is substantially instantaneously reduced and melting occurs in the lower part of the reactor. The molten metal runs down to the bottom of the reactor and is withdrawn via a tapping channel 15, while the slag is continuously or intermittently tapped through a tapping channel 16.

According to the invention, the desired temperature (e.g. between 1500° and 1650° C.) in the reduction zone of the reactor can easily be regulated by means of a plasma burner. The reactor and coke bed may in this case be dimensioned so that the dust containing metal oxides is collected in the lower part of the hot coke bed 17 and the gas leaving the reactor consists of a mixture of carbon monoxide and hydrogen gas.

Reference is made to the following example in order to further explain the invention.

EXAMPLE 1

One ton of material in dust form containing metal oxides, namely chromiferous dust, was taken from the walls of the flue gas filters in the manufacture of stainless steel. The dust had an original particle size of 2–6 μm and the following composition:

13% $Cr_2O_3$
38% $Fe_2O_3$
6% Ni 1.2% $MoO_3$ and the remainder slag, such as CaO, $SiO_2$, etc. The dust was blown continuously into the reduction zone of the reactor after mixing with 320 kg carbon powder and 12 kg $SiO_2$ (slag-former). The energy requirement for maintaining a temperature of about 1550° C. in the reduction zone was about 2600 kWh, said temperature being generated with the help of a plasma burner.

The following was obtained:

475 kg crude iron with a chromium content of 21%, as well as 11% Ni and 2.3% Mo

620 $Nm^3$ reaction gas consisting of

70% CO

20% $H_2$ and 10% of a mixture of nitrogen, carbon dioxide and water.

The reaction gas had a thermal value of about 2700 kilo calories/$Nm^3$.

I claim:

1. A method of recovering nonvolatile metals from material in dust form containing metal oxides in a reactor having an upper and a lower portion, said material containing at least one of the group consisting of chromium, nickel and molybdenum, comprising the steps of blowing the material together with carbon containing coal powder into the lower portion of the reactor, said reactor containing a solid reducing agent at least in said lower portion, passing said material and powder into a reduction zone within said solid reducing agent in said lower portion, said reduction zone being maintained by the use of a plasma generator adjacent thereto, substantially instantaneously melting and reducing said starting material in said reduction zone, and removing the melted and reduced metal product from the bottom of the reactor.

2. A method according to claim 1 including the step of maintaining the temperature of the melted product in the reactor at a temperature of from about 1500° C. to about 1650° C.

3. A method according to claim 1 wherein the starting material also includes a slag former.

4. A method according to claims 1, 2, or 3 wherein the starting material is blown into the reactor together with a carrier gas.

5. A method according to claim 4 wherein a portion of the reaction gas generated in the reactor is used as a carrier gas.

6. A method according to claim 4 wherein a portion of the reaction gas generated in the reactor is used as a plasma gas.

* * * * *

UNITED STATES PATENT AND TRADEMARK OFFICE

Certificate

Patent No. 4,310,350 Patented January 12, 1982

Sven Santen

Application having been made by Sven Santen, the inventor named in the patent above identified, and SKF Steel Engineering Aktiebolag, the assignee, for the issuance of a certificate under the provisions of Title 35, Section 256, of the United States Code, adding the name of Borje Johansson as a joint inventor, and a showing and proof of facts satisfying the requirements of the said section having been submitted, it is this 12th day of June, 1984, certified that the name of the said Borje Johansson is hereby added to the said patent as a joint inventor with the said Sven Santen.

Fred W. Sherling,
*Associate Solicitor.*